US006241425B1

(12) United States Patent
Kazim

(10) Patent No.: US 6,241,425 B1
(45) Date of Patent: Jun. 5, 2001

(54) TETHERED MARINE STABILIZING SYSTEM

(76) Inventor: Jenan Kazim, 26 London Road, St. Albans., Herts AL1 IGN (GB)

( * ) Notice: Subject to any disclaimer, the term of this patent is extended or adjusted under 35 U.S.C. 154(b) by 0 days.

(21) Appl. No.: 09/202,702

(22) PCT Filed: Jun. 11, 1997

(86) PCT No.: PCT/GB97/01563

§ 371 Date: Dec. 11, 1998

§ 102(e) Date: Dec. 11, 1998

(87) PCT Pub. No.: WO97/47515

PCT Pub. Date: Dec. 18, 1997

(30) Foreign Application Priority Data

Jun. 11, 1996 (GB) ..... 9612196

(51) Int. Cl.[7] ..... B63B 35/44
(52) U.S. Cl. ..... 405/200; 405/224
(58) Field of Search ..... 405/205, 204, 405/224, 195.1, 209, 206, 207; 441/3, 5; 114/230.13, 230.2, 230.1; 166/355; 175/24

(56) References Cited

U.S. PATENT DOCUMENTS

| | | | | |
|---|---|---|---|---|
| 3,294,051 | | 12/1966 | Khelstovsky . | |
| 3,390,654 | | 7/1968 | Bromell et al. . | |
| 3,391,666 | | 7/1968 | Schuller . | |
| 4,039,177 | | 8/1977 | Person et al. . | |
| 4,049,239 | * | 9/1977 | Howell | 166/355 |
| 4,362,438 | * | 12/1982 | Spink | 166/355 X |
| 4,367,981 | * | 1/1983 | Shapiro | 405/195.1 |
| 4,428,702 | | 1/1984 | Abbott et al. . | |
| 4,576,520 | * | 3/1986 | Suh et al. | 405/205 X |
| 4,721,053 | * | 1/1988 | Brewerton | 114/230.13 |
| 4,799,827 | * | 1/1989 | Jaqua | 405/195.1 |
| 4,898,288 | | 2/1990 | Erdbrink . | |
| 4,913,592 | * | 4/1990 | Petty | 405/224 X |
| 4,934,870 | * | 6/1990 | Petty et al. | 405/199 |
| 5,209,302 | * | 5/1993 | Robichaux et al. | 175/5 X |
| 5,363,788 | | 11/1994 | Delrieu . | |

FOREIGN PATENT DOCUMENTS

| | | |
|---|---|---|
| 1197385 | 12/1985 | (CA) . |
| 2574367 | 6/1986 | (FR) . |
| 2681831 | 4/1993 | (FR) . |
| 2083788 | 3/1982 | (GB) . |
| 2 150 516A | 7/1985 | (GB) . |

* cited by examiner

*Primary Examiner*—David Bagnell
*Assistant Examiner*—Frederick L. Lagman
(74) *Attorney, Agent, or Firm*—Galgano & Burke

(57) ABSTRACT

A buoyancy assembly suitable for supporting, either alone or in combination, a load deck or other marine body, said assembly comprising:

i) a first portion adapted to be connected to or form an integral part of the marine body, said portion incorporating a piston;

ii) a second portion adapted to envelope the piston and thus create a variable volume chamber, the first and second portions being moveable with respect to each other;

iii) sealing means adapted to form a fluid tight seal between the piston and the second portion;

iv) a constant pressure source adapted to maintain a constant pressure within the variable volume chamber;

v) tether means adapted to tether the second portion to the sea bed;

wherein the buoyance assembly is adapted such that displacement of the marine body from its hydrostatic equilibrium position results in the generation of a restoring force, upwards or downwards, tending to restore equilibrium.

10 Claims, 10 Drawing Sheets

TETHERED MARINE STABILIZING SYSTEM

FIELD OF THE INVENTION

The invention relates to a buoyancy assembly suitable for use with marine bodies. It is particularly applicable to marine bodies that penetrate the water surface, such as oil and gas facilities and bridges, fully submerged bodies and bodies which rest on the sea bed.

BACKGROUND TO THE INVENTION

There have been a number of ways that stability has been provided for in marine structures in the past.

Floating facilities either ship-shape or column stabilised, achieve stability through changing buoyancy by a part of their body moving in or out of water. It is because of this requirement that a large part of their body providing buoyancy and stability is exposed to maximum environmental loading.

Submarines achieve static stability by ballast control using the power of pumps to pump water in or out of the vessel as required.

Non-floating structures are stabilised either by piling to the sea bed as foundation or by being attached to large weights known as gravity foundations.

There are also tethered structures which have tethers stabilised by gravity or piling, acting against the buoyancy of a floating vessel and keeping the tethers always in tension. The stability of the vessel is either provided by the tension in the tethers or a combination of the tension as well as the buoyancy changes due to the vessel coming in or out of the water.

Providing piled stabilised foundation is expensive, requiring specialised crane vessels, pile driving hammers and the expense of the piles. Gravity stabilised foundation require large, usually concrete, structures and expensive ballast systems. These structures need to be either externally stabilised for transportation and installation offshore or their stability element would need to be water surface piercing attracting environmental loads. Structures sitting on the sea bed fully submerged would need crane vessels to lower them down or raise them up and still require to be stabilised by a foundation.

Floating facilities which are utilised as offshore platforms for mineral production require to keep station whilst being connected to the source of the minerals. However, as they need to be surface piercing for their function and stability, they are at times subjected to severe environmental loads. In order to minimise their motions and for station keeping a number of facilities have been developed. These include:

Dynamic positioning systems which use trusters to resist the wave forces. These are also used to turn a ship around to face the waves. Turrets are required to allow the ships to turn around a moonpool housing pipes connected to the source of the minerals.

Tensioners can be used but these have the expense of the foundation as well as the tensioners.

In summary, the known technology is expensive to install and expensive to operate on a day-to-day basis. No one technology can provide buoyancy and stability when partially and fully submerged as well as providing foundation stability to a structure sitting on the sea bed. No one existing marine stabilising system has the facility to alter its dynamic characteristics to suit changes in the environmental loads.

The closest prior art known to the applicant is the inventor's own earlier application PCT/GB95/02883. This describes a buoyancy assembly comprising the first unit and a second unit which, in combination contain a volume of compressed gas. Both the first and second units are free to move up and down in order to vary the volume of compressed gas contained therein.

Whilst this arrangement can maintain hydrostatic equilibrium it tends to require active rather than passive ballast control to be effective. This requires expensive equipment and complex control circuits.

It is the object of the present invention to overcome some or all of these disadvantages.

This invention relates to buoyancy assemblies that can provide hydrostatic stability even when fully submerged, and which have the facility for altering their dynamic characteristics and provide sea bed foundations that minimise or eliminate the vertical loads acting on the sea bed.

SUMMARY OF THE INVENTION

According to the present invention there is provided a buoyancy assembly suitable for supporting, either alone or in combination, a load deck or other marine body, said assembly comprising:

i) a first portion adapted to be connected to or form an integral part of the marine body, said portion incorporating a piston;

ii) a second portion adapted to envelope the piston, the first and second portions being moveable with respect to each other, thereby creating a variable volume chamber;

iii) sealing means adapted to form a substantially fluid tight seal between the piston and the second portion;

iv) a constant pressure source adapted to maintain a constant pressure within the variable volume chamber;

v) tether means adapted to tether the second portion to the sea bed; wherein the buoyancy assembly is adapted such that displacement of the marine body from its hydrostatic equilibrium position results in the generation of a restoring force, upwards or downwards, tending to restore equilibrium characterised in that that constant pressure source is provided by connecting the variable volume chamber to atmosphere. Atmospheric pressure represents a virtually infinite source of constant pressure and is immediately available if suitable connections are made. Preferably the connection to atmosphere is provided by pipework connections through the marine body supporting structure. In particularly preferred embodiment the piston is substantially circular in shape and the second portion takes the form of an inverted circular cylinder, closed at one end.

Preferably the diameter of the cylinder decreases towards the open end. The constricted mouth of the inverted cylinder acts as damper due to the restricted water flow. The ratio of the area of the piston face to the area of the open end of the cylinder is typically 10:1. However, other ratios are possible.

Preferably the second portion is of sealed, double skin construction, natural buoyancy being achieved by enclosing gas within the sealed volume thus created. The distance between the skins and hence the volume created can be considerable, providing the second portion with substantial natural bouyancy, keeping the tethers in tension.

Preferably the first portion substantially encircles the second portion under conditions of minimum buoyancy.

The present invention extends to a marine body incorporating a buoyancy assembly as described herein and to a method of stabilising a marine body comprising the steps of:

a) providing one or more buoyancy assemblies as described;

b) attaching the or each buoyancy assembly to the marine body;

c) providing control means adapted to control the operation of the or each buoyancy assembly such that the marine body is stabilised at the desired point of hydrostatic equilibrium.

BRIEF DESCRIPTION OF THE DRAWINGS

Embodiments of the present invention will now be more particularly described by way of example only, and with reference to the accompanying diagrammatic drawings in which.

DESCRIPTION OF THE PREFERRED EMBODIMENTS

The following aspects and embodiments of the present invention represent the best ways known to the applicant of putting the invention into practice. However, these are not the only ways in which this can be achieved and are described here by way of example only.

The general principles underlying a buoyancy assembly of this general type have been described in PCT/GB95/02883 the text of which is incorporated here by reference. It is specifically intended that the inventive principles underlying this earlier disclosure should be and are part of this disclosure and this current invention.

Figure 2:
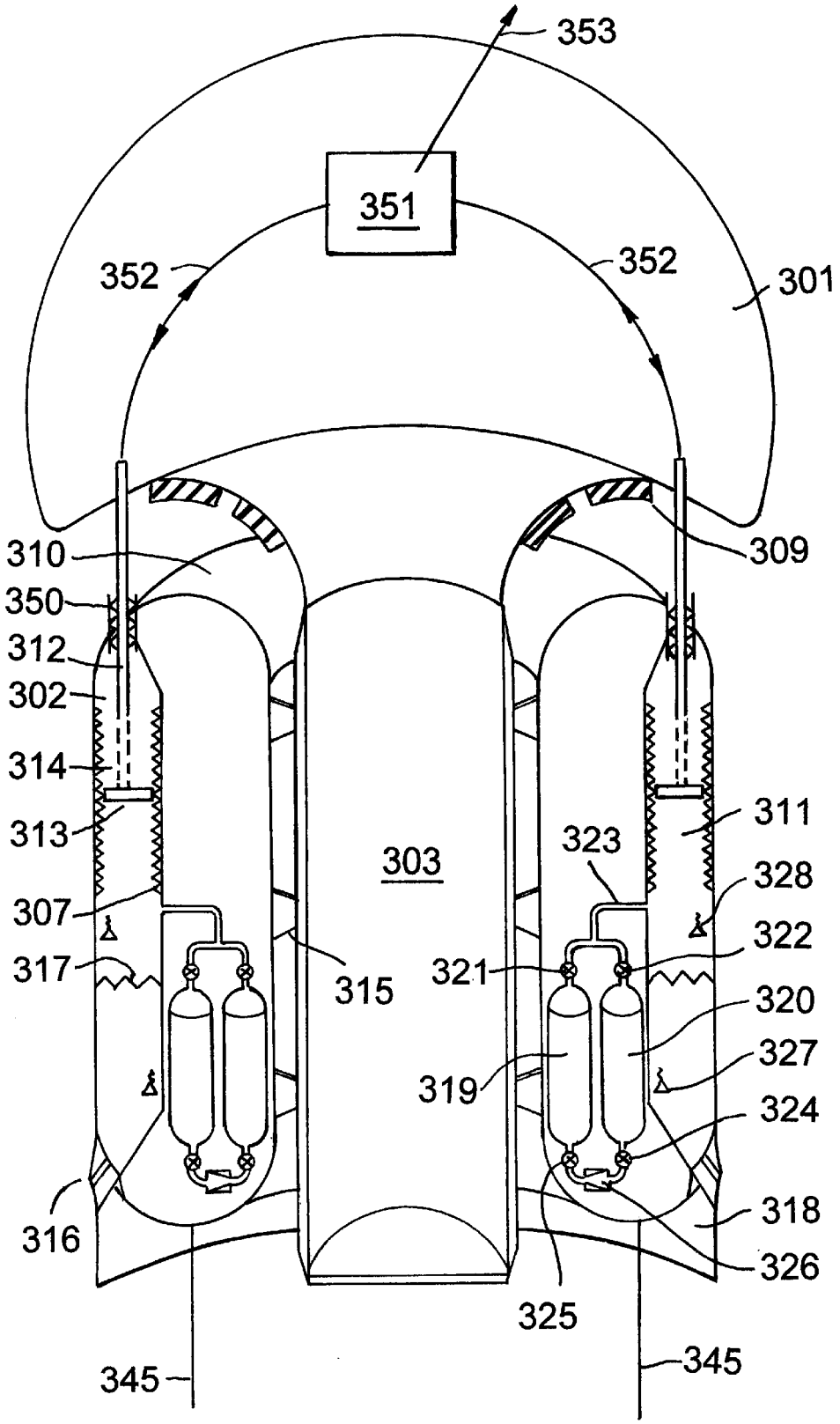
FIGS. 2 to 5 show various cross-sectional views of the innovative units exposing their working components.

The first embodiment of the invention is shown in FIG. 2 showing the two fundamental units in their in-use configuration. Unit 1 consist of an inner chamber marked 301 and a depending closed-ended cylinder 303. Unit 2 envelopes the piston of unit 1 creating variable volume chamber marked 302 maintained at a constant pressure. These chambers are connected to a constant pressure source via openings 352.

In the present invention there are important modifications to the prior art. First, the provision of the constant pressure chamber above the piston. Second, closing the end of the unit 1 central column marked 303. Third, unit 2 is now tethered to the sea bed under tension.

The outer shell of unit 1 may optionally be extended to shroud unit 2 and minimise the effect of the environment on it. The shroud typically has inclined slatted openings marked which allow free water flow through the inclined openings whilst stopping current or waves to effect the area inside. The bumpers/rubbing strips, marked 309 are used to allow unit one to rest on the buoyancy tanks, marked 310 of the unit 2 for transportation. The constant pressure chamber is sealed off from the sea via air tight seals in the plunger chamber marked 307.

Unit 2 consists of the buoyancy tanks marked 310, the optional active ballast tanks marked 319–328, plunger pipe marked 312, plungers marked 313 and plunger opening marked 314. The plunger openings are provided as perforations in the plunger pipe 312 close to the plunger 313. These perforations allow the free flow of gas to maintain chamber 302 at constant pressure. The plunger is free to move vertically within the plunger chamber with the constant pressure air above the plunger sealed from the sea below. The active ballast tank is open to the sea at the bottom through the inclined slatted openings marked, 316. The opening is slatted to minimise the effect of the environment in the tank. The level of water in these tanks is dependant on the pressure from the sea at the level of the openings, and the compressed air pressure acting on the ballast water surface marked 317. Therefore, any change in the air pressure in the plunger chamber due to the movement of the plungers would affect the air pressure within the tank and thus the level of the ballast water.

Unit 2 could also have a skirt which is open ended and provides additional hydrodynamic resistance and also if set on the sea bed it would penetrate into the soil and provide sliding stability. In this case the bottom of the tanks would act as mud mats on the soil. The unit 2 is attached by anchors or other tether systems marked 345 to anchors or some other heavy object 336, which could have its own ballast system. The anchor chains or tethers are extended using winches or other tension devices. In operating conditions when the unit is at hydrostatic equilibrium, these tethers provide a constant tension against the excess buoyancy provided by the unit 2 keeping the anchors or tethers in tension at all times.

Unit 3 is the air vent and compressed air supply system for so-called active ballasting. This system has been described in detail in PCT/GB95/02883 and is incorporated herein by reference.

When unit 2 as described above is tethered to the sea bed then unit 2 assumes a positive buoyancy, any downward movement by unit 1 will initially be resisted by this positive buoyancy.

Any upward movement of unit 2 will be resisted by the tether tension which is dependent on the stiffness of the tether itself.

It will thus be appreciated that the positive buoyancy in unit 2 is the excess buoyancy developed in equilibrium with the tether. The effective gives a stiffer, more stable platform. The stability of the platform is no longer dependent solely on the constructional details of unit 2, or unit 1 and unit 2 in combination. Nor is it entirely dependent upon the hydrodynamic damping of unit 2. The result of this modification which tethers unit 2 under tension to the sea bed means that either unit 3 is no longer necessary or it is only required as a back-up facility. This can greatly simplify the construction of the system with attendant savings in cost. The tethers effectively turn an active system as previously described into a passive system with improved performance characteristics.

Figure 3:
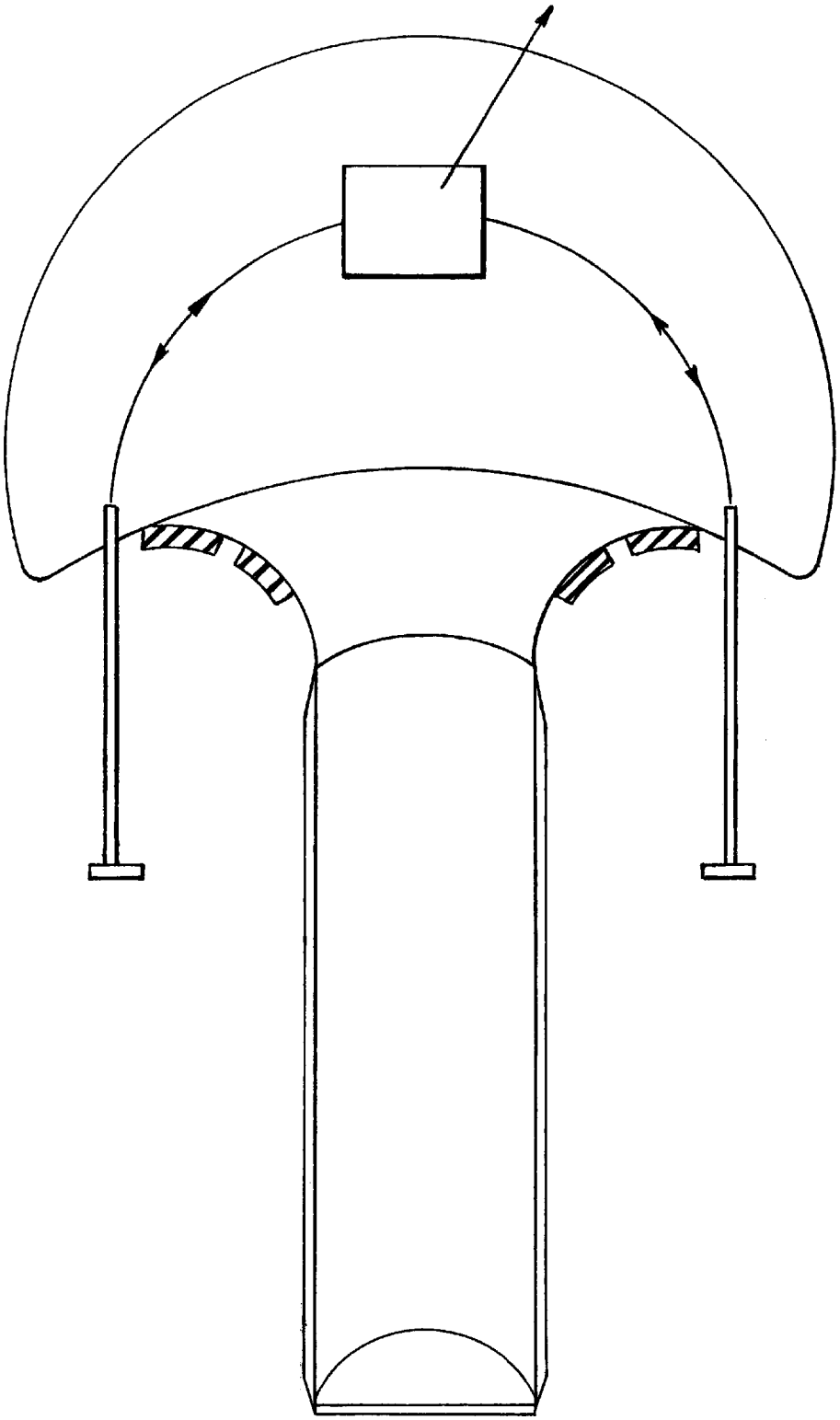

The basic features of the first embodiment can be summarised as follows. The stabilising assembly is made in two fundamental units. Unit 1 is shown separately as FIG. 3 which essentially consists of an enclosed buoyancy chamber which is shaped to allow unit 2, described as a passive ballast chamber, to freely slide up and down the central column of unit 1.

Figure 1:
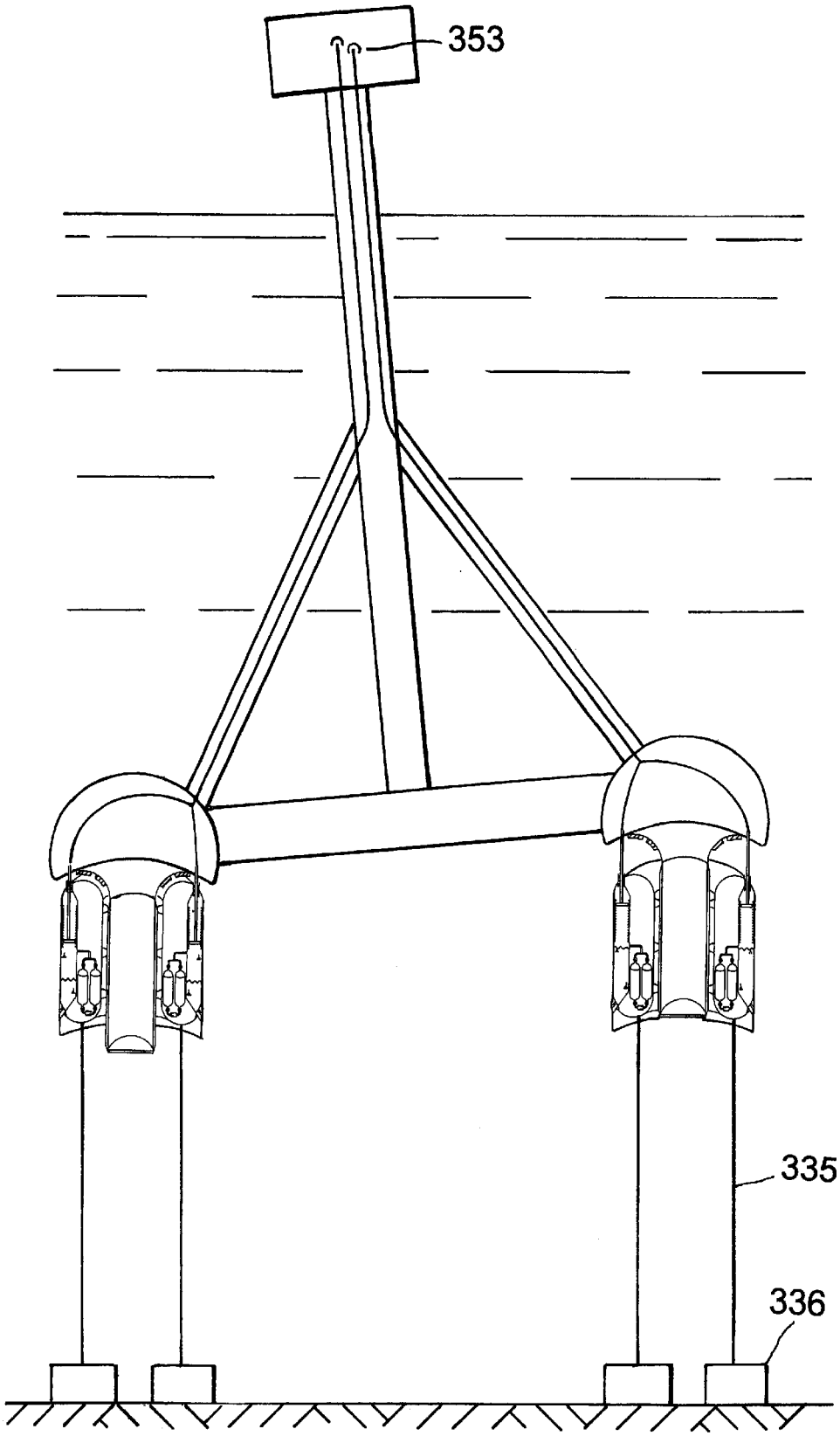
FIG. 1 is an elevation view showing a typical use for the buoyancy assembly, in this case a floating platform where virtually all the hydrostability is provided by the innovative units fully submerged at an equilibrium depth.

Unit 1 consists of an enclosed buoyancy chamber marked 301 which is attached to the marine body typically shown in FIG. 1. It would normally have a central column designed to allow unit 2 to slide freely up and down. The plunger column marked 312 and the plungers marked 313 are also part of unit 1 and rigidly fixed to it. The plunger column has an opening marked 314 which allows the flow from pipes marked 352 in to the air chamber in unit 2 marked 302. The pipes marked 352 are used to maintain constant pressure in the air chamber marked 302 by either having an opening to the atmosphere through the marine body marked 353 or by a constant pressure supply system marked 351. The active constant pressure supply system can be accommodated totally within unit 1 or can be accommodated in the deck of the marine body. Controlling the rate of flow in and out of the constant pressure chamber alters the dynamic characteristics of the system.

If the required design constant pressure is atmospheric, then the constant air pressure chamber 351 can be open to atmosphere. This provides, in effect, an infinite source of constant air pressure. The air chamber 302 is sealed by the plunger marked 313 and seal 307 at the lower portion and a seal marked 350 at the higher portion. The attachments marked 309 are bumpers when two units come together.

Plunger column 312 is perforated as marked 314 close to the plunger 313. This arrangement provides for the air chambers 351 and 302 to be at the same, constant pressure, whatever the relative position of plunger 313 in the air chamber 302.

Unit 2 is essentially a buoyant system marked 310 which is free to slide up or down with respect to unit 1. The sliding attachments are provided by the sliding joints marked 315, which in this case are shown around the central column of unit 1. Unit 2 is essentially a self stabilising passive ballast chamber. The unit 2 is stabilised in one or a combination of the following two ways:

1. Having anchor chains or tethers marked 335 attached to anchors or other fixed foundations marked 336 on the sea bed. It would have a positive buoyancy in its equilibrium position against a tension in the anchor chains or the letters.
2. Having low and high pressure supply system marked as 319, 320, 321, 322, 323, 324, 325 and 326 actively adjusting its buoyancy.

Unit 2 has a ballast chamber which has an opening to the sea marked 316. The hydrostatic water pressure in the ballast chamber acts on the bottom surface of the plunger providing additional buoyancy force for unit 1. This chamber can either be full of water up to the plunger or can have compressed air in chamber marked 311. Providing air in this chamber has the disadvantage that the air is compressible and this may cause some loss of buoyancy, but it has the advantage of keeping the plunger 313 and the seal 307 within an air medium and also acts as an air cushion, damping the effect of the loading between the units. It will be designated based on reliability and cost considerations. This simplifies the engineering design of the system considerably.

Figure 4:
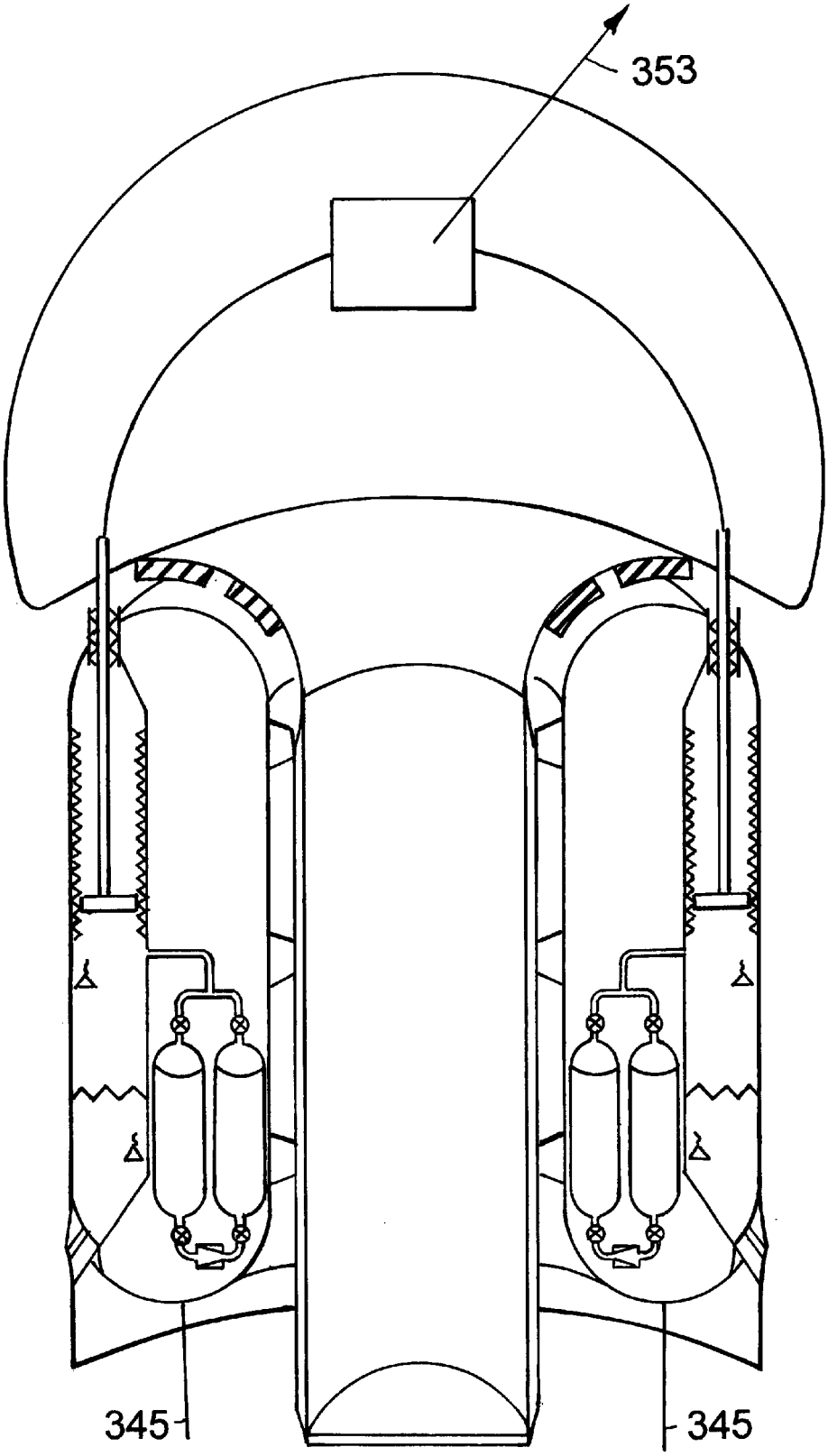
Figure 5:
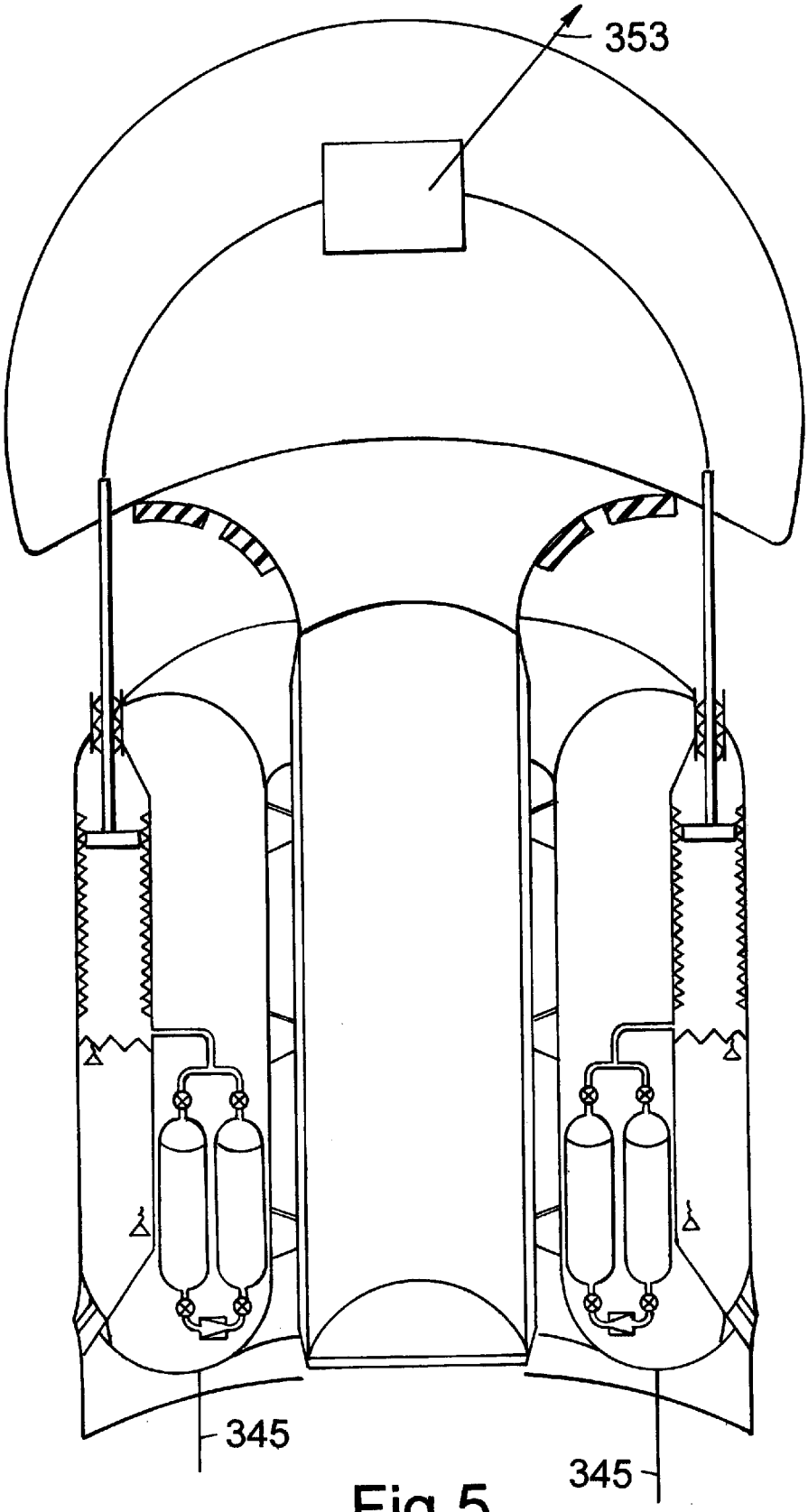

The fundamental principals of the system are described as follows:

In equilibrium position unit 1 has adequate buoyancy to support its own weight and that of the marine body deck and cargo. This buoyancy force is partly due to displaced water volume of unit 1, other submerged enclosed structures attached to it and the force acting on the plunger. The force acting on the plunger is due to unbalance of pressure on the lower and upper surfaces of the plunger. The pressure on the lower surface is at hydrostatic head of the sea and the pressure on the top is kept constant, typically at atmospheric. When the marine body is disturbed as shown in FIG. 1 unit 1 would either be pushed up or down. When pushed down, as in FIG. 4, the plunger would move downwards within the ballast chamber. This is because unit 2 is held under tension as explained above and would also resist movement due to its own inertia and hydrodynamic drag. The unit 2 would also be subjected to a lower level of loading being furthermost away from wave zone. When the plunger moves down the hydrostatic pressure on the lower surface will go up whilst on the upper surface the pressure will remain constant essentially by sucking air from the atmosphere. This will increase the buoyancy force acting on unit 1 until the out of balanced force is stabilised. Movement of the plunger within unit 2 does not alter the buoyancy of unit 2 as long as the pressure in the air chamber marked 302 is maintained.

If the plunger moves upwards with respect to unit 2 then the hydrostatic pressure acting on the lower surface of the plunger will be reduced whilst the pressure on the upper surface will remain constant by essentially expelling air in to the atmosphere. This will reduce the buoyancy of unit 1 until equilibrium is reached.

Figure 6:
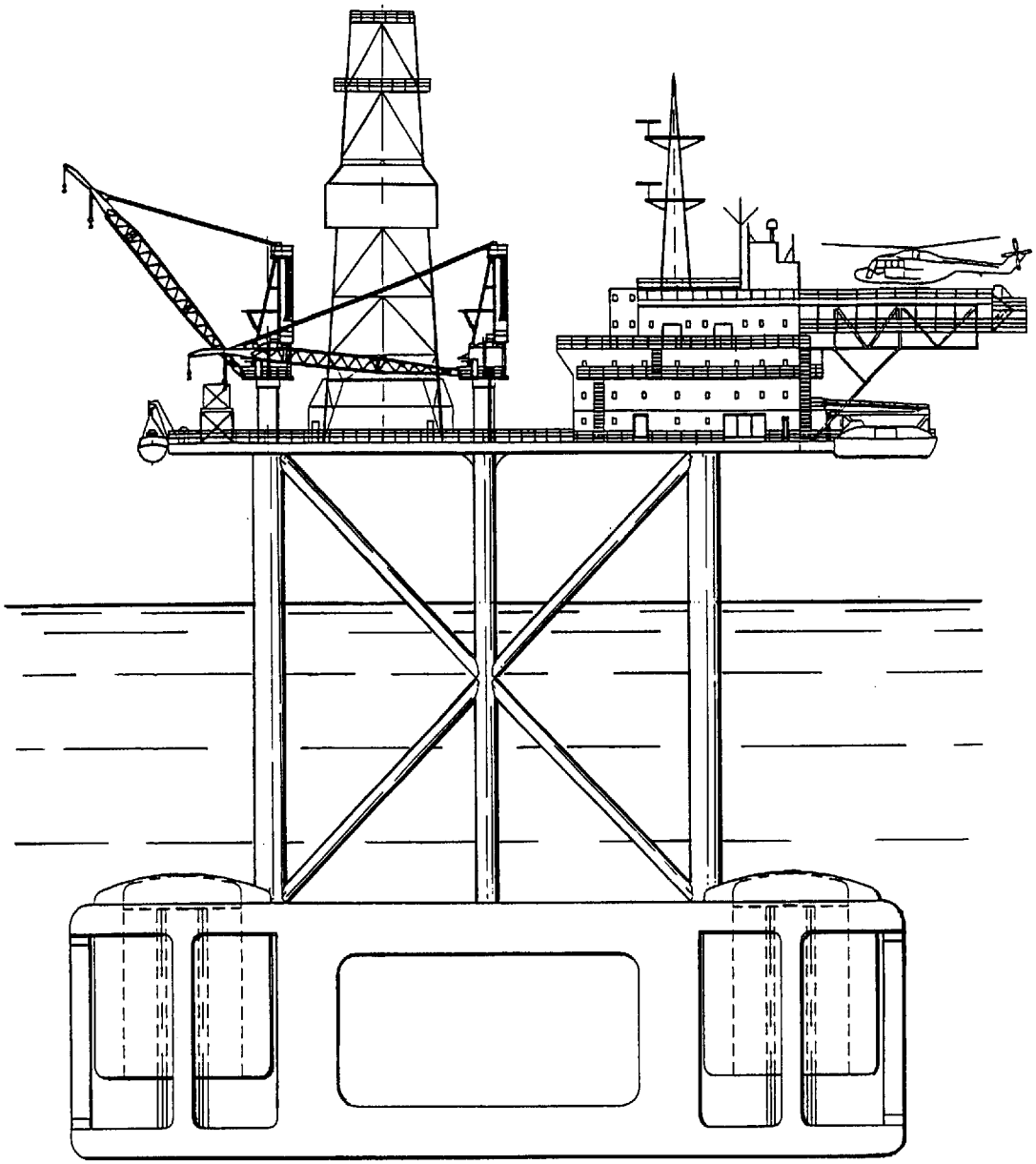
FIG. 6 shows an off shore facility with four stabilising pods in the form of fully submerged pontoons.
Figure 7:
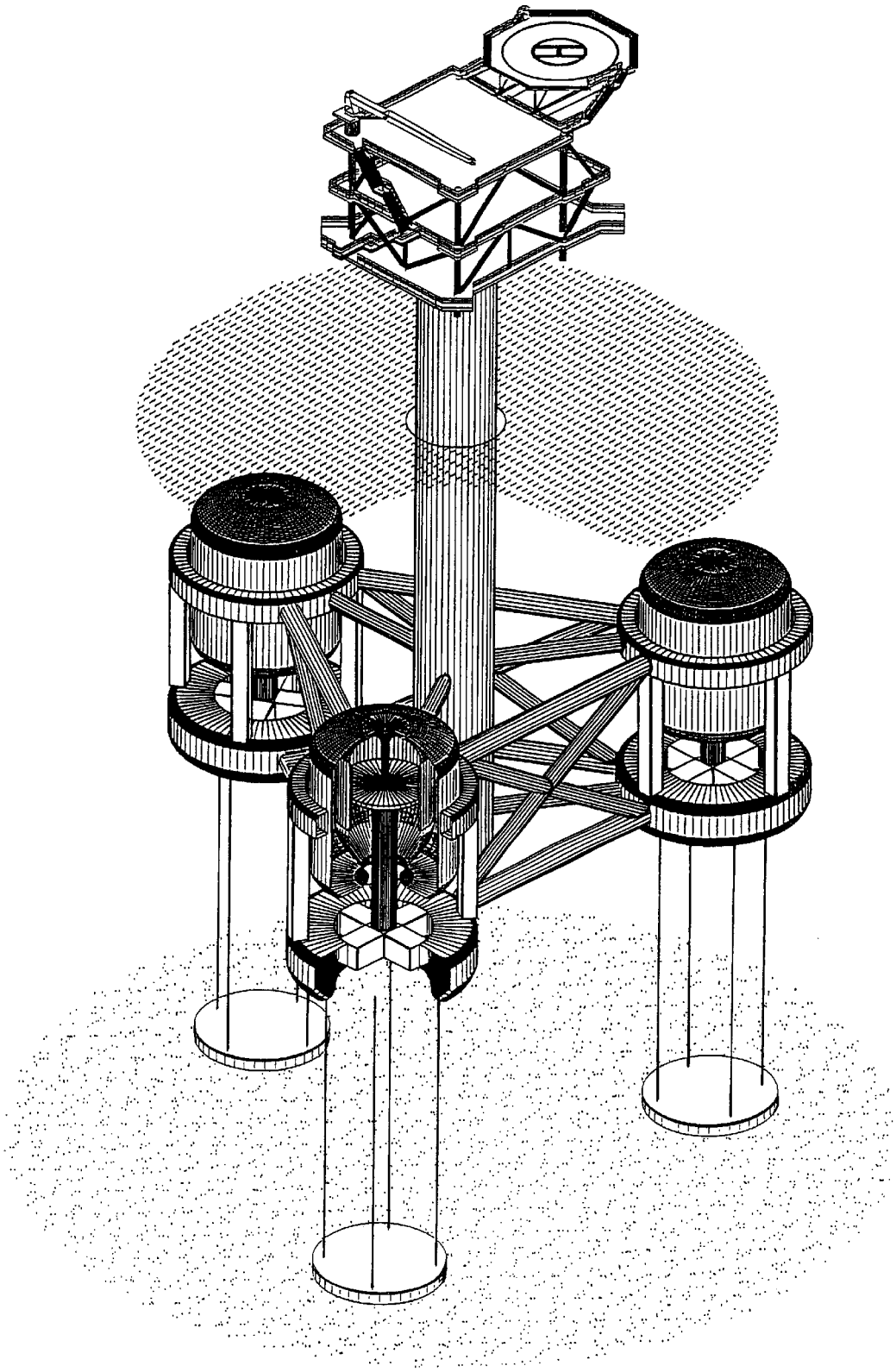
FIG. 7 shows an off shore facility with three stabilising pods and a central column supporting the off shore facility wherein one of the innovative pods is shown with the external shell structures partly removed.
Figure 8:
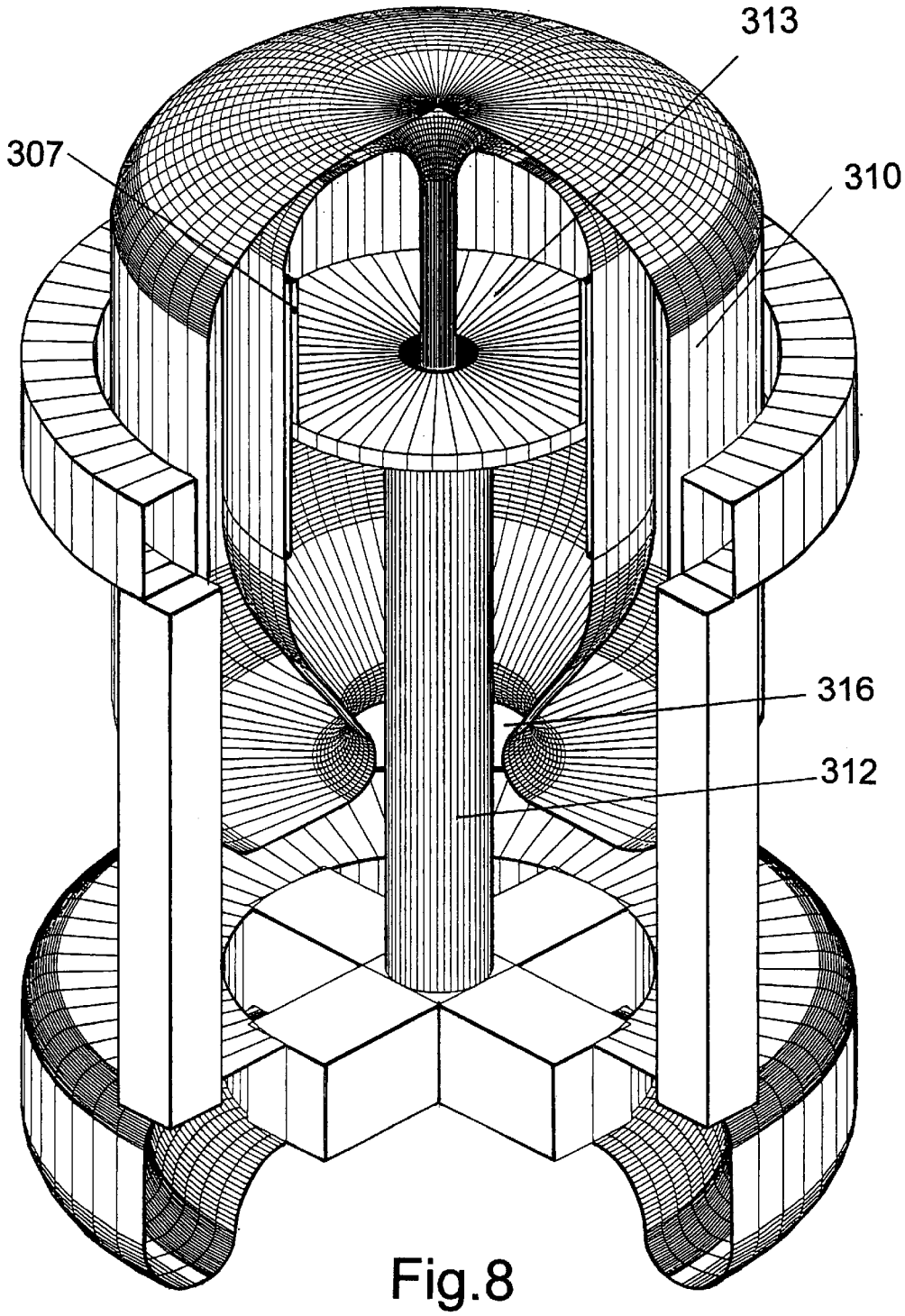
FIGS. 8 and 8A show the pods in greater detail, FIG. 8A illustrating a version without a central guide means.
Figure 8A:
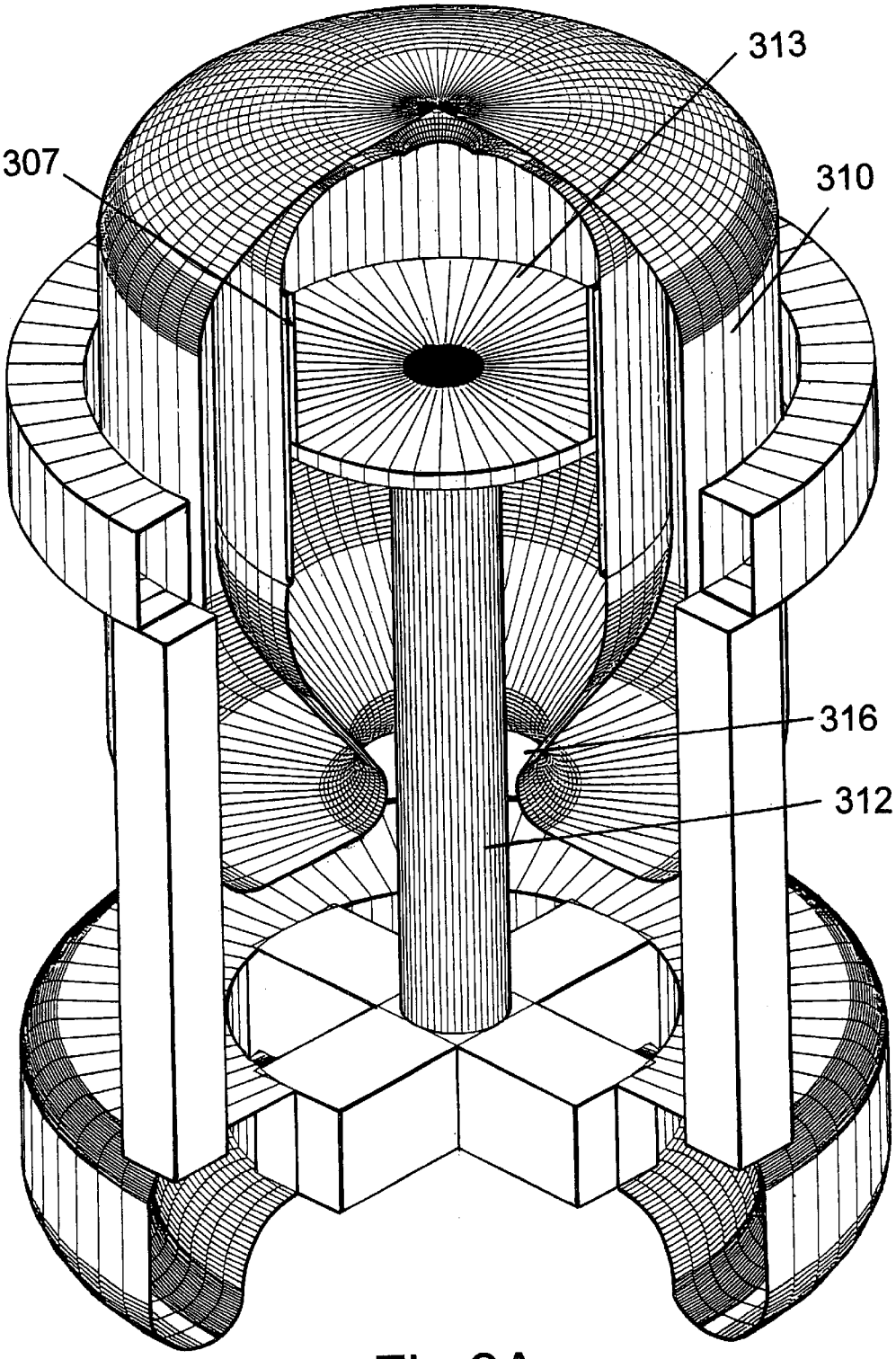

A further embodiment of the application of the present invention is shown in FIGS. 6 to 10. FIG. 6 shows an offshore facility with 4 stabilising pods, fully submerged to pontoons and small diameter structural columns supporting a drilling facility, accommodation and cargo. FIG. 7 shows an offshore facility with 3 stabilising pods and a central column supporting an offshore facility. In FIG. 7 one of the innovative pods is shown with the external shell structures partly removed allowing a clear view of the inside of unit 2 showing the piston which is fixed on to unit 1 and the marine body. This pod is shown more clearly in FIG. 8. FIG. 8A shows a version of this type of pod in which the central guide means passing down the centre of the plunger or piston column has been removed. This leaves the full internal diameter of the plunger column as a passageway for the movement of constant pressure air or for access.

Figure 9:
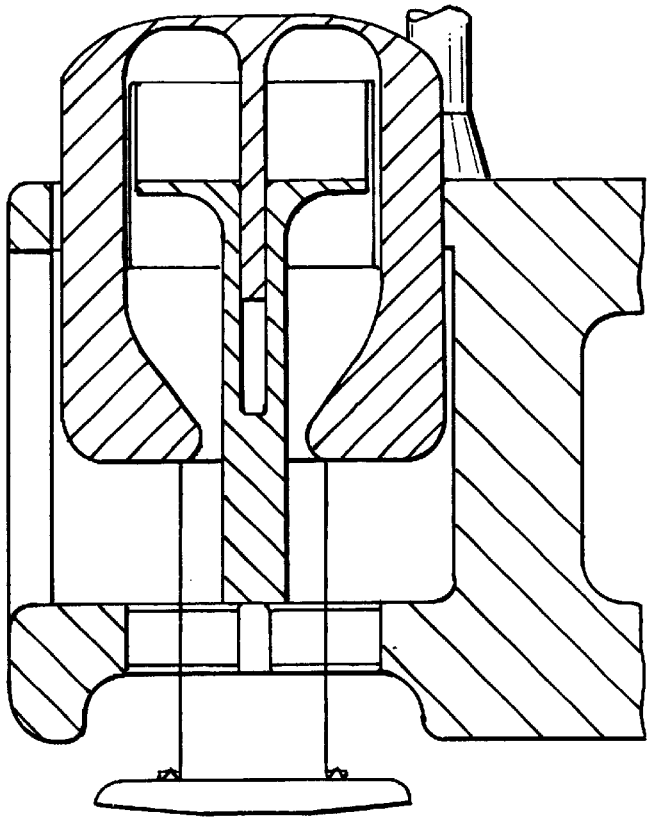
FIG. 9 shows a cross-section through a typical pod a maximum buoyancy with the anchor deployed.
Figure 10:
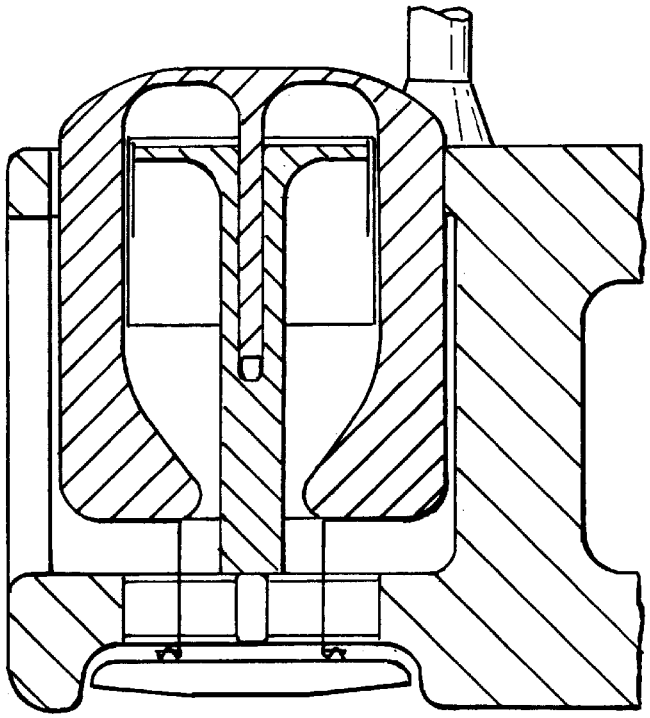
FIG. 10 shows a cross-section through a typical pod at minimum buoyancy with the anchor retrieved.

The advantage of this overall arrangement is that the seal around the piston column and unit 2 is no longer required. This is because in this arrangement the unit 2 passive ballast chamber opening marked 316 is utilised for the piston column. The seal 307 around the plunger is shown as a flexible rubber cylinder, one end attached to the circumference of the piston whilst the other end is attached on to the inside wall of the unit 2. The differential pressure below and above piston forces the rubber cylinder to loop, one side being forced flat against the inside wall of unit 2 the other side stretching in towards the inside of the constant air chamber above the piston. As the piston move up or down, the rubber seal ravels or unravels itself on to the wall of unit 2. The rubber cylinder can be made of a number of layers for added safety. FIG. 9 shows this arrangement with maximum buoyancy with the piston fully extended with respect to unit 2 and the anchor being lowered. FIG. 10 shows this arrangement with minimum buoyancy with the piston at is uppermost position with respect to unit 2 and the anchors retrieved.

In this second embodiment the structural features have in effect been inverted with respect to the first embodiment. The single, large diameter piston 313 coupled with the relatively small diameter port 316 through which displaced water must pass provide much improved performance characteristics.

The flexible seal 307 can be constructed from any suitable plastics, rubber or other material as selected by the material specialist. Alternative sealing arrangements are also possible and this disclosure is intended to encompass all forms of gas/water-tight seals or sealing systems.

It will be appreciated that the force that restores hydrostatic stability for floating vessels is dependent on the water displaced by the body as it moves in and out through the surface. Consequently, a large part of the body of conventional floaters is required to be near the surface where the environmental conditions are the harshest. The size of this water plane area is governed by the stability requirements.

This new innovation provides a hydrostatic restoring force passively generated by a submerged body. This submerged stability system essentially allows the design of floating vessels which are not limited to floating on the surface, but can also float at a distance below.

The system negates or minimises the exposure to the elements making it possible to design facilities such as reusable virtually fixed floating vessels, storage facilities below the wave zone and self installing reusable sub-sea installations.

The marine stabilising system comprises in essence two portions adapted to move vertically with respect to each other. A constant process chamber and a passive ballast system is used to generate a restoring force. For water depths up to 50 m below the main sea level the constant pressure chamber can be at atmospheric pressure, being directly connected to the atmosphere. When one portion moves with respect to the other the bellowing action either takes air in or expels it. The change in the displaced volume provides the static restoring force.

Computer simulations have been carried out to investigate the possible performance criteria of this new inventive concept. The analytical tools were based on PHOENICS computational Fluid Dynamics programme. These allowed simulation of the dynamic behaviour of each component, the fluid flows and investigation of the phasing relationship between them. A number of parametric studies were run covering different water displacements mass distributions and anchor spring stiffness. The loading conditions included regular and irregular waves in combination with variable static (cargo) and/or dynamic loads such as the crane or the derrick loading.

The results proved carefully that the fully passive submerged system would provide a stabilising force comparable to the conventional surface piercing elements for all the loading conditions.

FIG. 6 shows a conceptual design of a typical offshore facility incorporating the new innovation and demonstrated that the required range of stability can be achieved. The design has the same deck weight, pontoon weight, operating displacement, and variable deck loading as a popular semi-submersible drilling vessel.

The column diameter of the conventional semi-submersible is 12 m based on the stability requirements. The top of pontoon elevation is at 10 m below the main sea level. The top of pontoon elevation of the FIG. 6 design is at 30 m below main sea level and the columns are 3 m diameter based on the structural considerations. The stability being provided by the passive system which are incorporated in to the pontoon.

This study also demonstrated the design would satisfy the required stability criteria when in transit, in operating draft and during transition to and from the operating draft. At these diameters, the wave and current loading are inertia-dominated, which is proportional to the square of the diameter. The waves also loose 95% of their energy within half their wave length from the surface. For most operating waves this is approximately 50 m within which this new design showed up to 90% reduction in wane loads when compared to the conventional semi-submersible.

There have been major developments in the floating, and reusable facilities, such as the turet based monohulls, tension legs, spar and jack up based platforms. However, none have solved the problem inherent in all conventional floaters—their exposure to large environmental loads.

In the context of this disclosure the terms piston and plunger have a broad meaning. They are intended to encompass any shape or construction which can act to vary the volume of fluid beyond the plunger head. Whilst a circular-cylindrical arrangement as illustrated, any suitable size or shape of plunger will suffice.

For the avoidance of doubt, the invention is intended to encompass any tethered buoyancy assembly which contains a submerged buoyancy chamber maintained at a substantially constant pressure, the assembly being adapted such that movement of or about a piston or plunger causes a change in the submerged volume of said constant pressure chamber, thereby developing a stabilising hydrostatic force.

It will also be appreciated that the chamber above the piston, for example chamber 302, is the one which must be maintained at constant pressure for maximum efficiency. Importantly, this chamber can be maintained at a different pressure to the internal pressure within unit 1 or within the closed section of unit 2.

The preferred constant pressure will be determined by the operating and design perameters of each particular installation.

What is claimed is:

1. A buoyancy assembly suitable for supporting, either alone or in combination with one or more further buoyancy assemblies, a load deck or other marine body, said assembly comprising:

i) a first portion adapted to be connected to the marine body, said portion incorporating a piston;

ii) a second portion adapted to envelope the piston and thus create a variable volume chamber, said first and second portions being movable with respect to each other;

iii) sealing means adapted to form a fluid tight seal between said piston and said second portion;

iv) a constant pressure source adapted to maintain a constant pressure within said variable volume chamber; and v) tether means adapted to tether said second portion to the sea bed; wherein said buoyancy assembly is adapted such that displacement of the marine body from its hydrostatic equilibrium position results in the generation of a restoring force, upwards or downwards, tending to restore equilibrium.

2. A buoyancy assembly as claimed in claim 1 wherein the constant pressure source is provided by connecting the variable volume chamber to atmosphere.

3. A buoyancy assembly as claimed in claim 2 wherein the connection to atmosphere is provided by pipe work connections which are insertable through the marine body supporting structure.

4. A buoyancy assembly as claimed in claim 1 wherein said constant pressure source is provided by an active balance system incorporating a compressed gas source.

5. A buoyancy assembly according to claim 1 wherein said piston is substantially circular in shape and said second portion takes the form of an inverted circular cylinder, closed at one end.

6. A buoyancy assembly according to claim 5 wherein the diameter of said cylinder decreases towards the open end.

7. A buoyancy assembly according to claim 1 wherein said second portion is of sealed, double skin construction, natural buoyancy being achieved by enclosing gas within the sealed volume thus created.

8. A buoyancy assembly according to claim 1 wherein said first portion substantially encircles said second portion under conditions of minimum buoyancy.

9. A marine body comprising:

a marine structure; and a buoyancy assembly for stabilizing said marine structure comprising:

i) a first portion adapted to be connected to the marine body, said portion incorporating a piston;

ii) a second portion adapted to envelope the piston and thus create a variable volume chamber, said first and second portions being movable with respect to each other;

iii) sealing means adapted to form a fluid tight seal between said piston and said second portion;

iv) a constant pressure source adapted to maintain a constant pressure within said variable volume chamber; and v) tether means adapted to tether said second portion to the sea bed; wherein said buoyancy assembly is adapted such that displacement of the marine body from its hydrostatic equilibrium position results in the generation of a restoring force, upwards or downwards, tending to restore equilibrium.

b) attaching said buoyancy assembly to the marine body;

c) . . . equilibrium.

10. A method of stabilizing a marine body comprising the steps of:

a) providing at least one buoyancy assembly, said assembly comprising:

i) a first portion adapted to be connected to marine body, said portion incorporating a piston;

ii) a second portion adapted to envelope the piston and thus create a variable volume chamber, said first and second portions being moveable with respect to each other;

iii) sealing means adapted to form a fluid tight seal between said piston and said second portion;

iv) a constant pressure source adapted to maintain a constant pressure within said variable volume chamber; and v) tether means adapted to tether said second portion to the sea bed; wherein said buoyancy assembly is adapted such that displacement of the marine body from its hydrostatic equilibrium position results in the generation of a restoring force, upwards or downwards, tending to restore equilibrium.

b) attaching said buoyancy assembly to the marine body;

c) providing control means adapted to control the operation of said buoyancy assembly such that the marine body is stabilized at the desired point of hydrostatic equilibrium.

* * * * *